US006186802B1

(12) United States Patent
Masuda et al.

(10) Patent No.: US 6,186,802 B1
(45) Date of Patent: Feb. 13, 2001

(54) SHIELDED CONNECTOR

(75) Inventors: Satoki Masuda, Shizuoka; Kouichi Shirouzu, Aichi, both of (JP)

(73) Assignee: Yazaki Corporation, Tokyo (JP)

( * ) Notice: Under 35 U.S.C. 154(b), the term of this patent shall be extended for 0 days.

(21) Appl. No.: 09/176,207

(22) Filed: Oct. 21, 1998

(30) Foreign Application Priority Data

Oct. 21, 1997 (JP) ..... 9-288970

(51) Int. Cl.[7] ..... H01R 13/648
(52) U.S. Cl. ..... 439/98; 439/95
(58) Field of Search ..... 439/578, 98, 95

(56) References Cited

U.S. PATENT DOCUMENTS

| | | | | |
|---|---|---|---|---|
| 3,877,775 | * | 4/1975 | Barlow et al. | 339/117 R |
| 4,990,105 | * | 2/1991 | Karlovich | 439/578 |
| 5,061,207 | * | 10/1991 | Wright | 439/578 |
| 5,597,322 | * | 1/1997 | Inaba et al. | 439/578 |
| 5,637,830 | * | 6/1997 | Hashizawa et al. | 174/84 R |

FOREIGN PATENT DOCUMENTS

| | | |
|---|---|---|
| 5-251116 | 9/1993 | (JP) . |
| 6-58560 | 8/1994 | (JP) . |
| 7-222392 | 8/1995 | (JP) . |
| 8-96868 | 4/1996 | (JP) . |
| 8-96895 | 4/1996 | (JP) . |

* cited by examiner

*Primary Examiner*—Brian Sircus
*Assistant Examiner*—Chandrika Prasad
(74) *Attorney, Agent, or Firm*—Sughrue, Mion, Zinn, Macpeak & Seas, PLLC

(57) ABSTRACT

A shielded connector for connecting a braided covering of a shielded wire to a metallic case of an apparatus, the shielded connector including a connector housing made of metal composed of an attaching section for directly attaching the connector to the metallic case and a cylindrical body. In the shielded connector, a cylindrical conductive short-circuit piece is clamped to the braided covering of the shielded wire, so that the short-circuit piece can be contacted with the connector housing when the shielded wire is inserted into the connector housing, and both can be electrically connected and fixed to each other.

4 Claims, 6 Drawing Sheets

SHIELDED CONNECTOR

BACKGROUND OF THE INVENTION

1. Field of the Invention

The present invention relates to a shielded connector for connecting a braided covering of a shielded wire to a metallic case of an apparatus so that the braided covering can be grounded. More particularly, the present invention relates to a shielded connector, the structure of which is simple so that the assembling work can be simplified and further the shielding property and the reliability of connection can be enhanced.

2. Description of the Related Art

In order to shut off electric noises such as electromagnetic waves and static electricity, there is provided a shielded electric wire to be used as a high-tension electric wire composed in such a manner that a core covered with and insulated by an inner covering is further covered with a braided covering, and furthermore the braided covering is covered with a sheath for insulation.

In order to connect the braided covering of the shielded wire to a metallic case of an apparatus so that the braided covering can be grounded, a special shielded connector has been conventionally used.

First of all, a shielded connector of a first conventional example, which is disclosed in Japanese Utility Model Unexamined Publication No. Hei. 6-58560, will be described below.

FIG. 5 is a cross-sectional view showing a shielded connector of the first conventional example.

In FIG. 5, reference numeral 1 is a shielded electric wire, which includes a core 1A, an inner covering 1B for covering and insulating the core 1A, a braided covering 1C for covering the outside of the inner covering 1B, and a sheath 1D for covering and insulating the braided covering 1C.

At an end portion of the shielded electric wire 1, the inner covering 1B and the sheath 1D are peeled off stepwise, so that the core 1A and the braided covering 1C are exposed.

The end portion of the shielded electric wire 1 composed as described above is attached to a metallic case 2 of an apparatus (not shown) via a shielded connector 100.

An outline of the structure of the shielded connector 100 is described as follows. A connector housing 104 is made of synthetic resin, and a cylindrical metallic shell 101 is insert-molded to the connector housing 104. Further, a terminal metal fitting 105, a connecting member 103 and a rubber plug 102 are accommodated in the connector housing 104.

On an outer circumference of the connector housing 104, there are provided flanges 104*a*, 104*a* which are formed integrally with the connector housing 104. In each flange 104*a*, there is provided a bolt hole for directly attaching the connector housing 104 to the metallic case 2.

In the metallic shell 101, there are provided contact pieces 101*a*, 101*a* corresponding to the flanges 104*a*, 104*a*. When the connector housing 104 is directly attached to the metallic case 2, these contact pieces 101*a*, 101*a* are electrically connected to the metallic case 2.

The core 1A of the shielded electric wire 1 is connected to one side of the terminal metal fitting 105, and an electric wire of the apparatus is connected to the other side of the terminal metal fitting 105.

The terminal metal fitting 105 described above is fixed to the connector housing 104 by a stop ring 107.

The connecting member 103 is formed into a ring-shape which coincides with a profile of the rubber plug 102. The connecting member 103 is press-fitted into the braided covering 1C, so that the braided covering 1C can be connected to the metallic shell 101.

The rubber plug 102 is provided for ensuring the water-tightness in the connector housing 104. The rubber plug 102 is fixed to the connector housing 104 by a rubber plug holder 106.

In the shielded connector 100 composed as described above, when the connector housing 104 is directly attached to the metallic case 2, the metallic shell 101 can be connected to the metallic case 2 via the contact pieces 101*a*, 101*a*.

Due to the foregoing, the braided covering 1C of the shielded electric wire 1 connected to the metallic shell 101 via the connecting member 103 is grounded to the metallic case 2.

Next, a shielded connector of a second conventional example will be described below which is disclosed in Japanese Patent Unexamined Publication No. Hei. 8-96868.

FIG. 6 is a cross-sectional view showing a shielded connector of the second conventional example.

In FIG. 6, an outline of the structure of a shielded connector 200 is described as follows. A rubber plug 202, a connector housing 203 made of synthetic resin and a spring piece 204 are successively inserted into a cylindrical metallic shield cap 201 which corresponds to the metallic shell 101 described above. A metallic shield ring 205 is attached to a braided covering 1C of a shielded electric wire 1.

In the shield cap 201, there is provided a flange 201*a*. The shield cap 201 is directly attached to a metallic case 2 of an apparatus (not shown) by fixing the flange 201*a* with bolts.

In the shielded connector 200 described above, when the shield ring 205 attached to the braided covering 1C of the shielded electric wire 1 is connected to the shield cap 201 via the spring piece 204, the braided covering 1C is grounded to the metallic case 2 of the apparatus.

However, the following problems may be encountered in the conventional shielded connectors 100 and 200 described above. The number of parts of the shielded connector of each conventional example is large, and further the structure is complicated. Therefore, it takes much time to assemble the conventional shielded connector. Furthermore, the shielding property of the conventional shielded connector is deteriorated.

In the shielded connector 200 of the second conventional example, the shield cap 201 and the connector housing 203 made of synthetic resin are formed separately from each other . Therefore, the number of parts is increased and further the number of steps required for assembling the shielded connector is increased.

On the other hand, in the shielded connector 100 of the first conventional example, the metallic shell 101 is insert-molded to the connector housing 104 made of synthetic resin. However, according to the above structure, the connector housing 104 and the metallic shell 101 must be press-formed separately from each other. As a result, the number of parts is increased and further the number of steps required for manufacturing the shielded connector is increased.

In the shielded connector 100 of the first conventional example, it is difficult to press-fit the shielded electric wire 1 into the connecting member 103 so that the braided covering 1C of the shielded electric wire 1 is not twisted. On the other hand, in the shielded connector 200 of the second conventional example, it is difficult to insert the shielded electric wire 1 into the shield ring 204 so that the braided covering 1C of the shielded electric wire 1 is not twisted. In both of the first and second conventional examples, skilled technique is required for assembling work of the shielded connector.

Further, in the shielded connector 100 of the first example and the shielded connector 200 of the second example, the structure is so complicated that it is impossible to assemble the shielded connector in such a manner that the shielded electric wire 1 is simply inserted into the parts composing the shielded connector and pushed into the connector housing 104 or 203.

In addition to that, when the connecting member 103 or the shield ring 205 is assembled to the braided covering 1C of the shielded electric wire 1, there is a possibility that the braided covering 1C is twisted. In this case, the contact becomes defective, and the shielding property is deteriorated.

SUMMARY OF THE INVENTION

The present invention has been made to solve the above problems. It is an object of the present invention to provide a shielded connector, the structure of which is simple so that the assembling work can be simplified and further the shielding property and the reliability of connection can be enhanced.

In order to accomplish the above object, the present invention provides a shielded connector for connecting a braided covering of a shielded wire to a metallic case of an apparatus, the shielded connector comprising a connector housing made of metal composed of an attaching section for directly attaching the connector to the metallic case and a cylindrical body, wherein a cylindrical conductive short-circuit piece is clamped to the braided covering of the shielded wire, so that the short-circuit piece can be contacted with the connector housing when the shielded wire is inserted into the connector housing, and both can be electrically connected and fixed to each other.

BRIEF DESCRIPTION OF THE DRAWINGS

FIG. 2(*b*) is a cross-sectional view showing the same, taken along line A—A in FIG. 2(*a*).

DETAILED DESCRIPTION OF THE PREFERRED EMBODIMENTS

Referring to the accompanying drawings, embodiments of the shielded connector of the present invention will be described below.

First, a shielded connector of the first embodiment of the present invention will be described.

Figure 1:
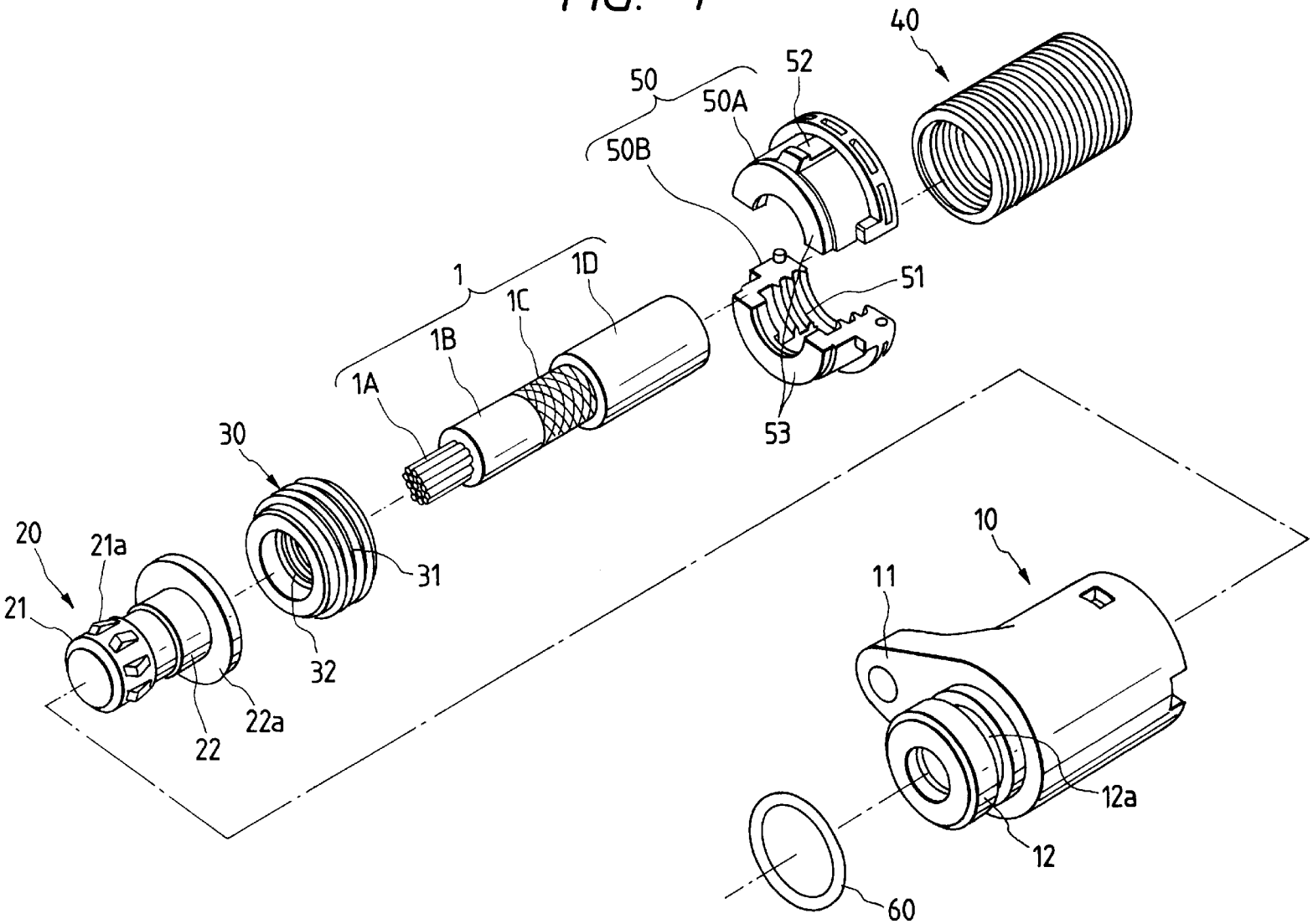
FIG. 1 is an exploded perspective view of a shielded connector of a first embodiment of the present invention.

FIG. 1 is an exploded perspective view of the shielded connector of the first embodiment of the present invention.

Figure 2B:
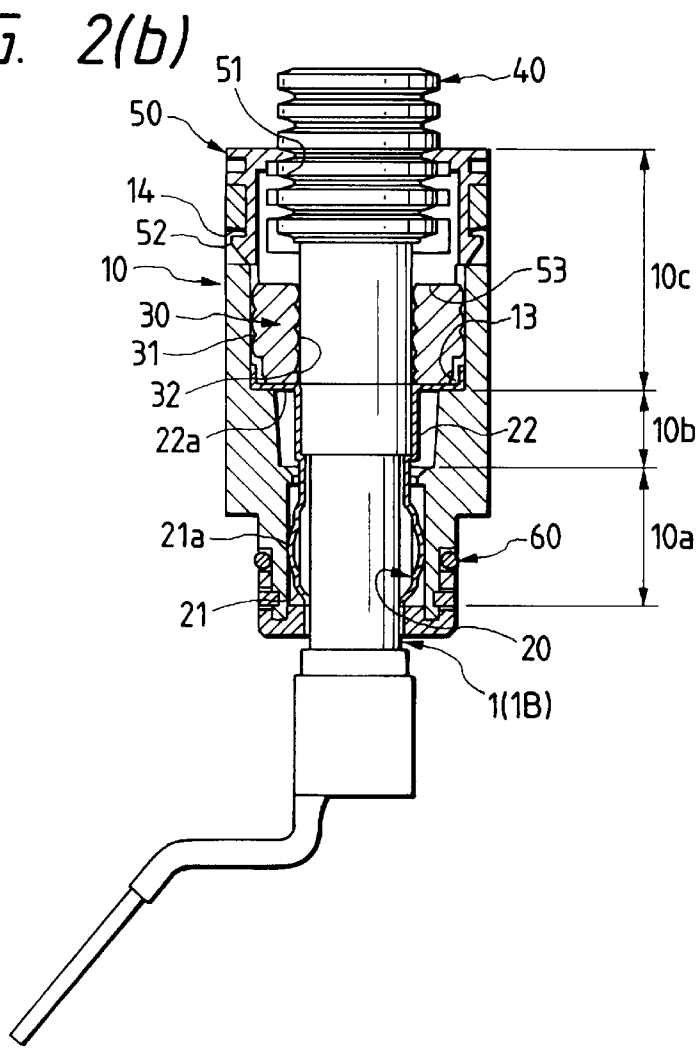
FIG. 2(*a*) is a side view showing an assembling condition of the shielded connector.
Figure 2A:
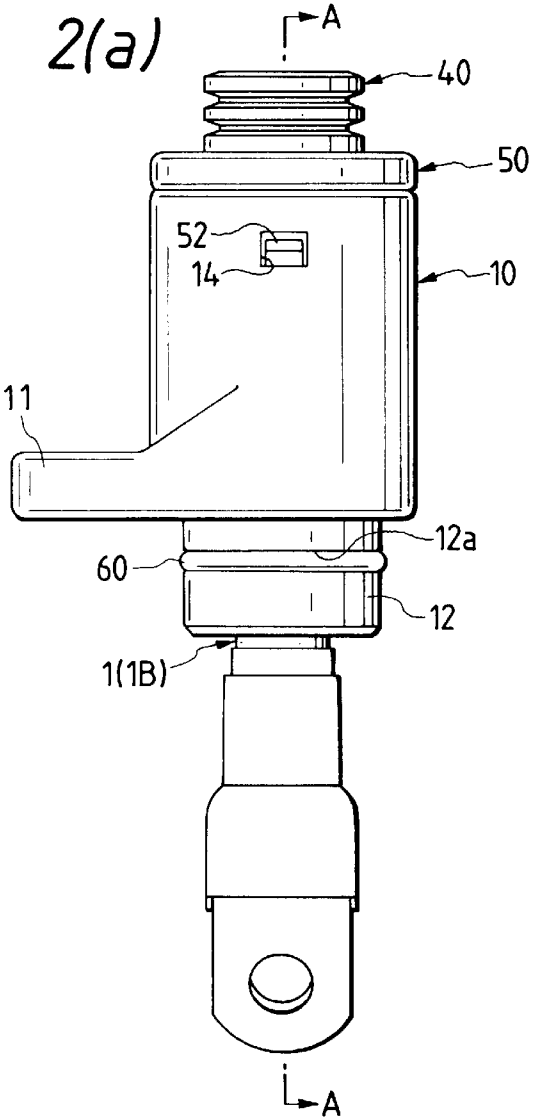

FIG. 2(*a*) is a side view showing an assembling condition of the shielded connector, and FIG. 2(*b*) is a cross-sectional view showing the same, taken along line A—A in FIG. 2(*a*).

Figure 3:
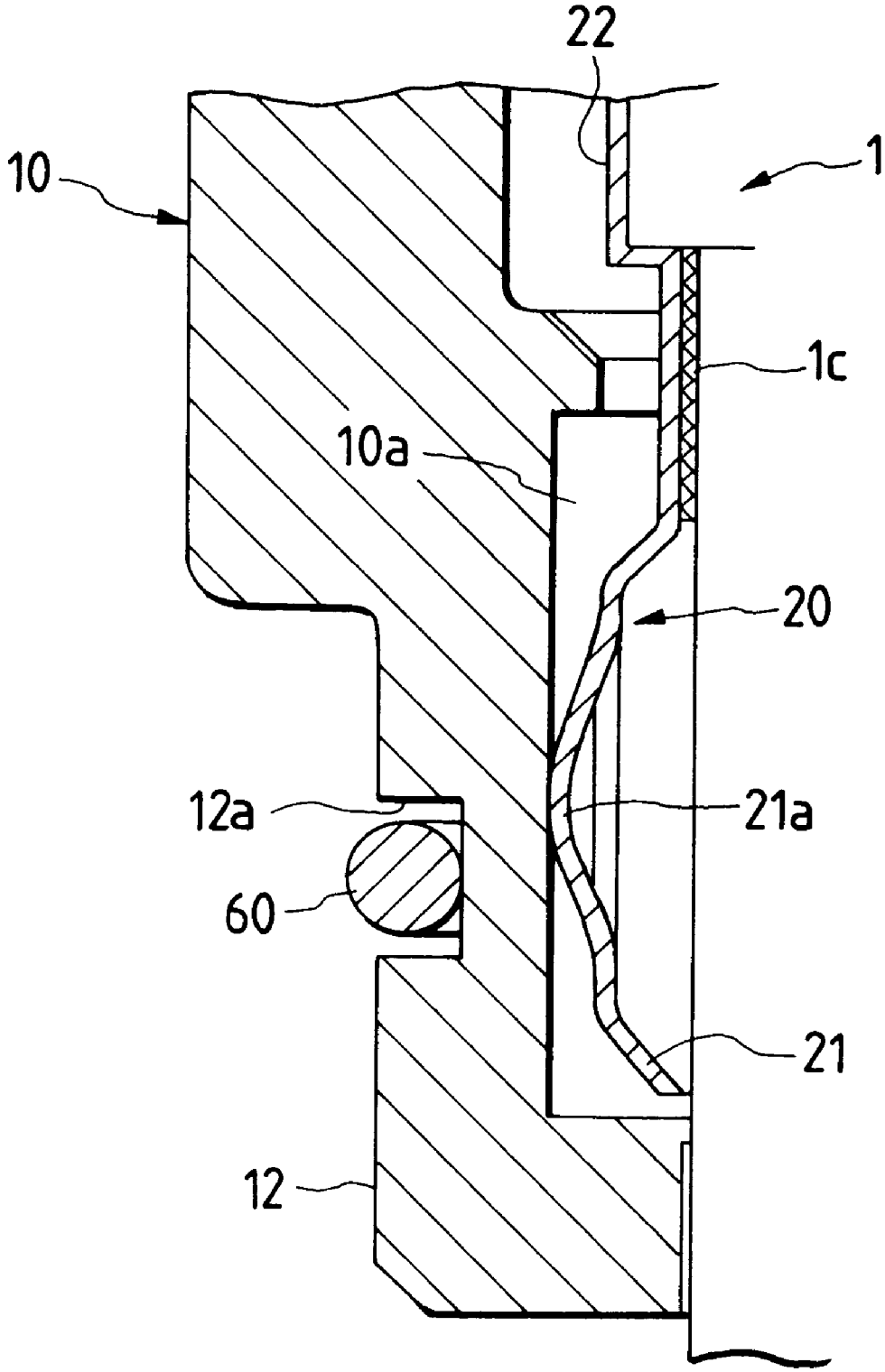
FIG. 3 is a partially enlarged view of FIG. 2(*b*).

FIG. 3 is a partially enlarged view of FIG. 2(*b*).

As shown in FIGS. 1 and 2(*a*), the shielded connector of this embodiment includes: a connector housing 10 made of metal, a short-circuit piece 20 made of metal, a sealing rubber member 30 made of rubber, a corrugated tube 40 made of synthetic resin, a corrugated tube holder 50 made of synthetic resin, and an O-ring 60 made of rubber.

The connector housing 10 is formed into a cylindrical shape, both ends of which are open. When consideration is given to providing a sufficiently high conductivity and mechanical strength, and also when consideration is given to reducing the weight and manufacturing cost, the entire connector housing 10 is made of aluminum.

The entire connector housing 10 made of aluminum is plated with copper, and further the copper layer is plated with tin. Due to the above arrangement, the electric conductivity can be enhanced and also the shielding property can be enhanced.

Outside the connector housing 10, there is provided a bracket 11, which is an attaching section, wherein this bracket 11 is integrated with the connector housing 10. When this bracket 11 is fixed with a bolt, the connector housing 10 is directly attached to a metallic case of an apparatus (not shown in the drawing).

In this connection, as long as it functions as the attaching section to be attached to the metallic case, it is not limited to the bracket, but a flange and others may be used.

At a forward end portion of the connector housing 10, there is provided an inserting section 12, the diameter of which is small. In the inserting section 12, there is provided an attaching groove 12*a* into which the O-ring 60 is attached.

The inserting section 12 is inserted into an insertion hole of the same diameter formed on the metallic case of the apparatus described above. At this time, the O-ring 60 attached into the attaching groove 12*a* ensures the water-tightness between the inserting section 12 and the insertion hole.

As shown in FIG. 2(*b*), a hollow section inside the connector housing 10 includes a small-diameter portion 10*a*, an intermediate-diameter portion 10*b* and a large-diameter portion 10*c* which are continuously arranged in this order from the forward end side.

The small-diameter portion 10*a* and the intermediate-diameter portion 10*b* form an accommodating section in which the short-circuit piece 20 is accommodated. Concerning the large-diameter portion 10*c*, the front half is an accommodating section in which the sealing rubber 30 is accommodated, and the rear half is an accommodating section in which the corrugated tube 40 and the corrugated tube holder 50 are accommodated.

A step portion, which is a boundary between the intermediate-diameter portion 10*b* and the large-diameter portion 10*c*, is an abutment portion 13 against a flange portion 22*a* of the short-circuit piece 20 (which will be described later).

As shown in FIGS. 2(*a*) and 2(*b*), on a wall of the large-diameter portion 10*c*, there are provided two engaging holes 14, 14 with which engaging claws 52, 52 (which will be described later) of the corrugated tube holder 50 are engaged.

In FIG. 1, the short-circuit piece 20 is formed into a substantially cylindrical shape, both ends of which are open.

The front half of the short-circuit piece 20 is a fixing body 21, and the rear half of the short-circuit piece 20 is a clamping body 22.

On a circumferential surface of the fixing body 21, there are provided a plurality of spring pieces 21*a* which are raised from the circumferential surface. At an end edge of the clamping body 22, there is provided the flange portion 22*a*, the diameter of which is the same as that of the intermediate-diameter portion 10*b* of the connector housing 10, by means of press forming.

In FIGS. 1 and 2(*b*), the sealing rubber 30 is a ring-shaped rubber plug, and a sheath 1D of a shielded electric wire 1 is inserted into the sealing rubber 30, which is accommodated in the connector housing 10.

Both an outer circumferential surface 31 and an inner circumferential surface 32 of the sealing rubber 30 are formed into a protruded and recessed surface. Therefore, the outer circumferential surface 31 can tightly adhere to the inner wall of the connector housing 10, and the inner circumferential surface 32 can tightly adhere to the sheath 1D of the shielded electric wire 1.

In FIG. 1, the corrugated tube 40 is a flexible bellows-shaped cylindrical body, which is attached at the rear of the connector housing 10 via the corrugated tube holder 50 (which will be described later).

The above corrugated tube 40 is bent in accordance with the bend of the shielded electric wire 1. Therefore, it is possible to prevent an excessive bend caused in a portion close to the connector housing 10, and at the same time, and the shielded electric wire 1 can be protected by the corrugated tube 40 from a shock given from the outside.

As shown in FIGS. 1 and 2(*b*), the corrugated tube holder 50 is composed of a pair of half covers 50A and 50B which are formed by dividing one piece of cover into two.

Inside of each half cover 50A or 50B, there are provided the engaging grooves 51, 51 which engage with the bellows-shaped outer circumference of the corrugated tube 40.

Outside of each half cover 50A or 50B, there are provided the engaging claws 52, 52 which engage with the engaging holes 14, 14 of the connector housing 10.

When the two pieces of half covers 50A and 50*b* are integrated with each other, the forward end surface of the integrated half cover is formed into a pushing surface 53, the diameter of which is substantially the same as that of the sealing rubber 30.

Next, referring to FIGS. 1, 2(*b*) and 3, the assembling procedure of this shielded connector will be described below.

First, the shielded electric wire 1 (shown in FIG. 1), the end portion of which has been subjected to terminal treatment, is inserted into the short-circuit piece 20, and the clamping body 22 of the short-circuit piece 20 and the braided covering 1C of the shielded electric wire 1 are positioned to each other. Then, the clamping body 22 is clamped, so that it can be connected to the braided covering 1C, and the short-circuit piece 20 can be fixed to the shielded electric wire 1.

Next, the shielded electric wire 1 is inserted into the connector housing 10, and then the abutment portion 13 of the connector housing 10 abuts against the flange portion 22*a* of the short-circuit piece 20. At the same time, the spring pieces 21*a* formed in the fixing body 21 of the short-circuit piece 20 come into pressure contact with the wall surface of the small-diameter portion 10*a* of the connector housing 10 (see FIG. 3).

Due to the foregoing, both are electrically connected and fixed to each other.

Next, the shielded electric wire 1 is inserted into the sealing rubber 30, and the sealing rubber 30 is temporarily inserted into the large-diameter portion 10*c* of the connector housing 10.

Next, the shielded electric wire 1 is inserted into the assembled body of the corrugated tube 40 and the corrugated tube holder 50. Then, the corrugated tube holder 50 is pushed into the large-diameter portion 10*c* of the connector housing 10 until the engaging claws 52, 52 are engaged with the engaging holes 14, 14.

At this time, the sealing rubber 30, which has been temporarily inserted, is completely pushed into the large-diameter portion 10*c* of the connector housing 10 by the pushing surface 53 at the forward end of the corrugated tube holder 50.

After that, the O-ring 60 is attached into the attaching groove 12*a* on the forward end side of the connector housing 10. In this way, assembling of the shielded connector is completed.

Then, the bracket 11 is fixed by a bolt, so that the connector housing 10 is directly attached to the metallic case of the apparatus described before. Thus, the braided covering 1C of the shielded electric wire 1 is grounded via the short-circuit piece 20, the connector housing 10 and the metallic case of the apparatus.

The shielded connector according to this embodiment is characterized in that: the connector housing made of synthetic resin and the metallic shell or the shield cap, which are conventionally composed separately from each other, are integrated with each other as the connector housing 10 made of metal. Therefore, it is possible to reduce the number of parts, and the structure can be simplified. Further, it is possible to enhance the assembling property.

It is possible to cover the overall end portion of the shielded electric wire 1 with the connector housing 10 made of metal. Therefore, the shielding property of the connector can be enhanced.

Since the short-circuit piece 20 is connected to the braided covering 1C of the shielded electric wire 1 by clamping, there is no possibility that the braided covering 1C is twisted which is caused in the arrangement of the conventional shielded connector, and it becomes possible to assemble the short-circuit piece 20 to the braided covering 1C simply. Therefore, both can be connected to each other in a good condition.

Due to the foregoing, it is possible to enhance the assembling property, the shielding property and the reliability of connection.

In addition to that, after the short-circuit piece 20 is clamped to the braided covering 1C of the shielded electric wire 1, the connector housing 10 is inserted into the shielded electric wire 1, so that the connector housing 10 can be simply fixed to the short-circuit piece 20. After that, only when the shielded electric wire 1 is successively inserted and pushed into the accessories (the sealing rubber 30 and the assembled body in which the corrugated tube 40 and the corrugated tube holder 50 are assembled) to be accommodated in the connector housing 10, the shielded connector can be simply assembled.

The flange portion 22*a* of the short-circuit piece 20 can be positively made to come into surface contact with the abutment portion 13 of the connector housing 10. Therefore, the shielding property and the reliability of connection can be enhanced.

The flange portion 22*a* functions as a stopper for positioning the connector housing 10. Therefore, the assembling property can be enhanced.

In addition to that, the spring pieces 21*a* are provided in the short-circuit piece 20. Due to this arrangement, only when the shielded electric wire 1 to which the short-circuit piece 20 is clamped is inserted into the connector housing 10, it is possible to fix the connector housing 10 to the short-circuit piece 20. Therefore, the assembling property can be enhanced.

By the existence of the spring pieces 21*a* and the flange portion 22*a*, there are provided two connecting portions in which the short-circuit piece 20 and the connector housing 10 are connected to each other. Accordingly, the shielding property and the reliability of connection can be enhanced.

Further, the short-circuit piece 20 and the connector housing 10 are elastically contacted with each other by the action of the spring pieces 21*a*. Due to this, the reliability of connection can be further enhanced.

Next, referring to FIG. 4, a shielded connector of the second embodiment of the present invention will be described below.

Figure 4:
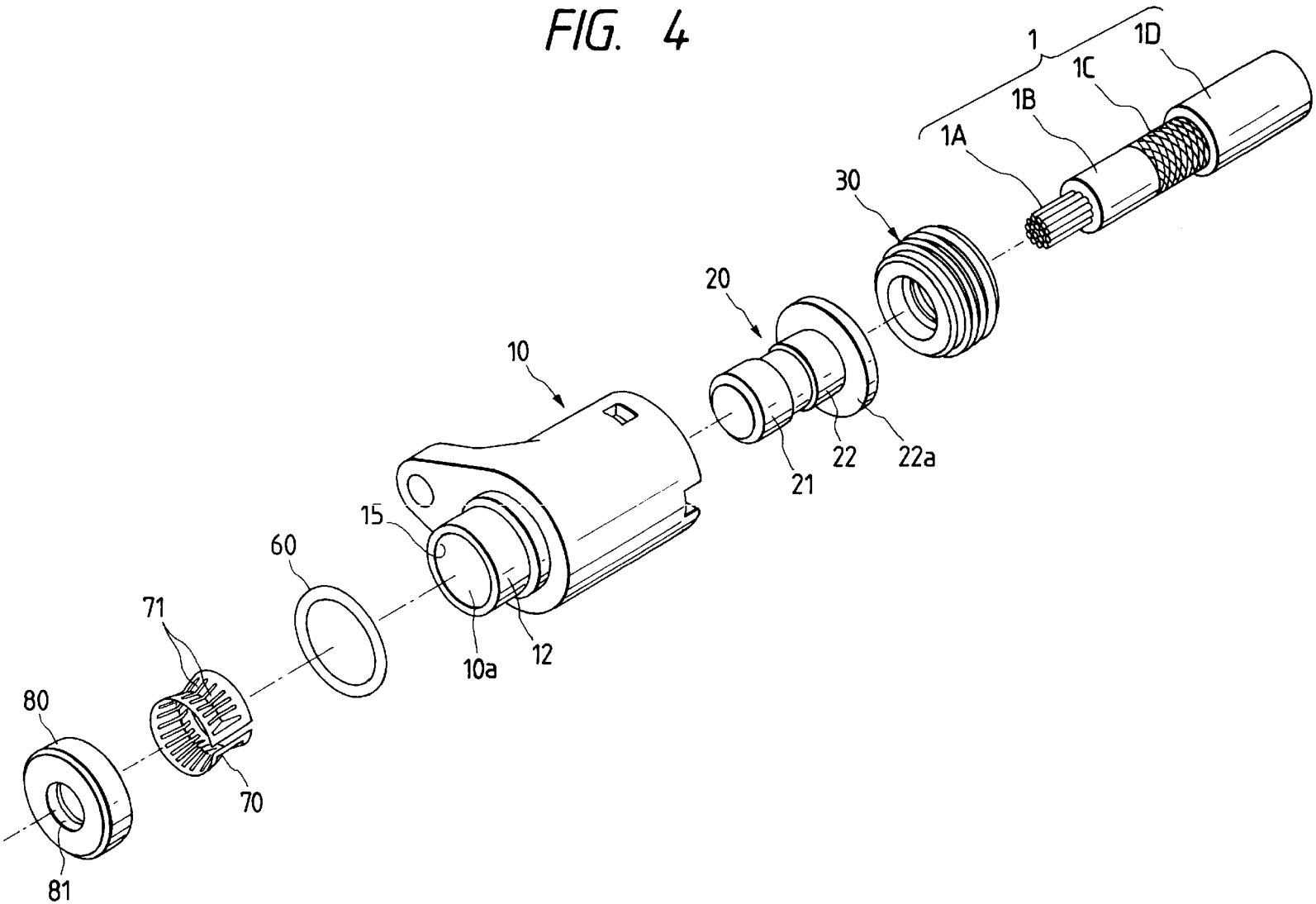
FIG. 4 is an exploded perspective view of a shielded connector of a second embodiment of the present invention.
Figure 5:
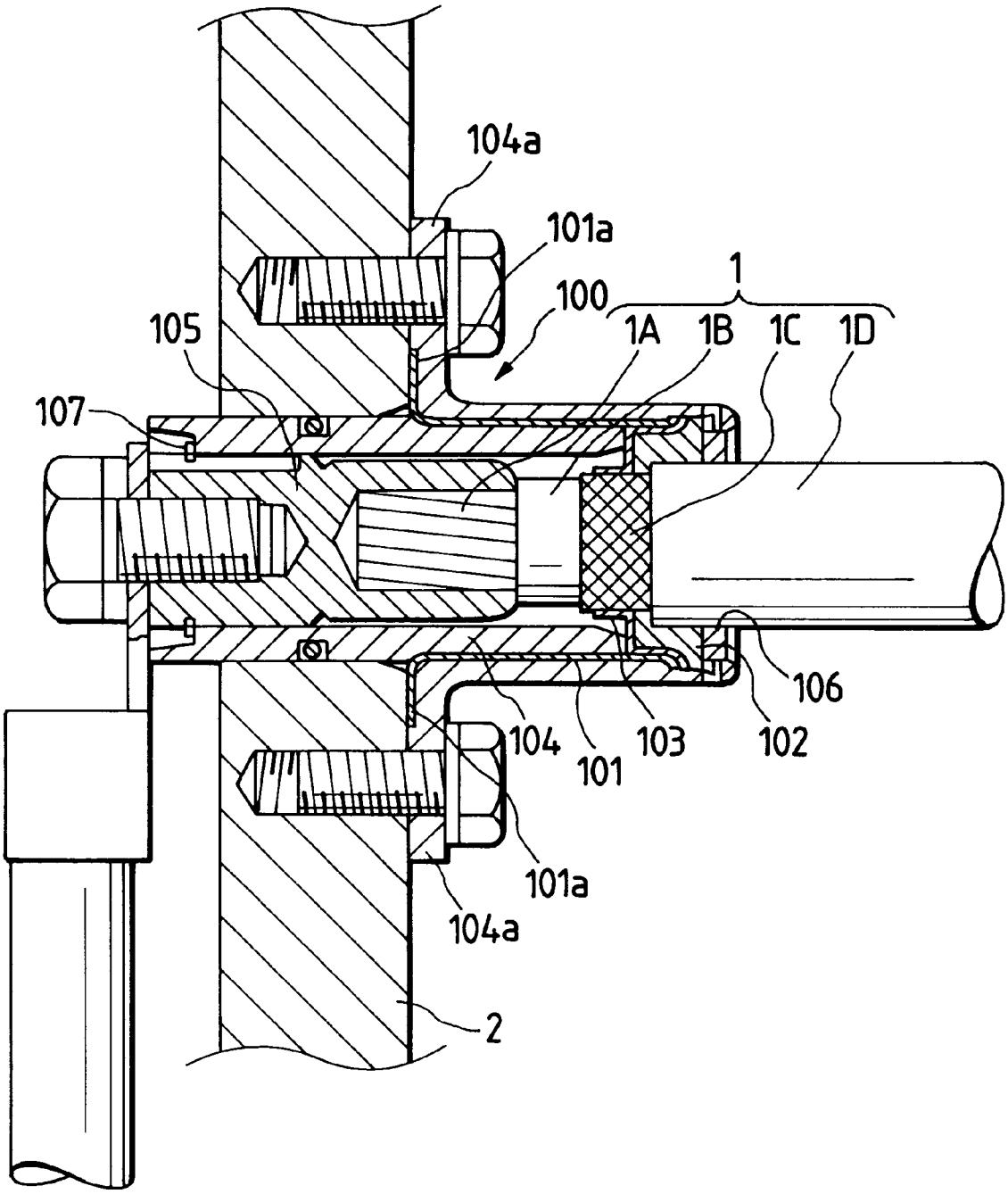
FIG. 5 PRIOR ART
FIG. 5 is a cross-sectional view showing a shielded connector of a first conventional example.
Figure 6:
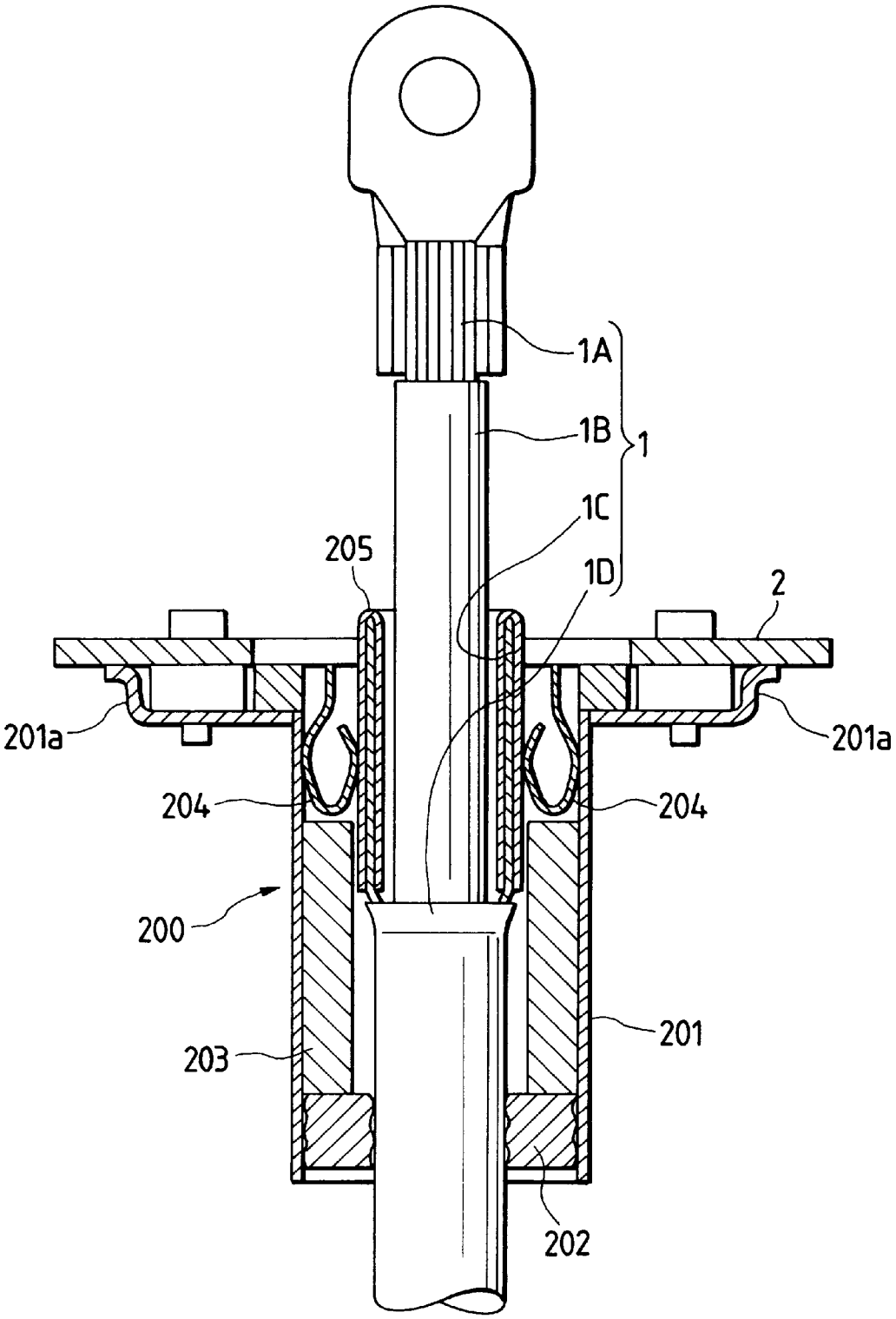
FIG. 6 PRIOR ART
FIG. 6 is a cross-sectional view showing a shielded connector of a second conventional example.

FIG. 4 is an exploded perspective view of the shielded connector of the second embodiment of the present invention.

In the shielded connector of the first embodiment described before, the connector housing 10 and the short-circuit piece 20 are electrically connected with each other, and the spring pieces 21*a* for fixing are provided in the short-circuit piece 20.

On the other hand, the shielded connector of this embodiment is composed as follows. As shown in FIG. 4, the spring pieces 21*a* are composed of an independent spring member 70. This independent spring member 70 is accommodated in the small-diameter portion 10*a* of the connector housing 10.

More specifically, the independent spring member 70 is composed as follows. The independent spring member 70 is formed into a ring-shape, the diameter of which is substantially the same as that of the small-diameter portion 10*a* of the connector housing 10. In the same manner as that of the spring pieces 21*a* described before, there are provided a large number of spring pieces 71.

In the inserting portion 12 of the connector housing 10, there is provided an opening 15, the diameter of which is the same as that of the small-diameter portion 10*a*, and it is possible to insert the spring member 70 from the opening 15 into the small-diameter portion 10*a*.

A cap 80, in which an insertion hole 81 of the same diameter as that of the inner covering 1B of the shielded electric wire 1 is formed, is attached to the opening 15.

In this connection, the corrugated tube 40 and the corrugated tube holder 50, which are shown in FIG. 1, are omitted in FIG. 4, however, the shielded connector of this embodiment is also provided with the corrugated tube 40 and the corrugated tube holder 50.

According to the above arrangement, in the same manner as that of the embodiment described before, the assembling property, the sealing property and the reliability of connection can be enhanced, and further it is possible to manufacture the spring member 70 easily by press forming.

It should be noted that the shielded connector of the present invention is not limited to the above specific embodiments. For example, the fixing body 21 of the short-circuit piece 20 may be engaged with the small-diameter portion 10*a* of the connector housing 10 without providing the spring pieces 21*a* or the spring member 70 so that both can be electrically connected and fixed to each other.

Further, it is possible to adopt an arrangement in which the short-circuit piece 20 has no flange 22*a* and a forward edge of the short-circuit piece 20 abuts against a forward end surface inside the connector housing 10.

Furthermore, the material to make the connector housing 10 is not limited to aluminum, but other metals may be used.

When consideration is given to providing a sufficiently high conductivity and mechanical strength, and also when consideration is given to reducing the weight and manufacturing cost, it is most preferable that the connector housing 10 is made of aluminum.

As described above, according to the shielded connector of the present invention, it is possible to simplify the structure and further it is possible to enhance the assembling property, the shielding property and the reliability of connection.

What is claimed is:

1. A shielded connector for connecting a braided covering of a shielded wire to a metallic case, said shielded connector comprising a connector housing made of metal and including an attaching section portion for directly attaching the connector to the metallic case and a cylindrical body portion having a bore; and a cylindrical conductive short-circuit piece received in said bore of said cylindrical body portion and clamped to the braided covering of the shielded wire, said short-circuit piece contacting said cylindrical body portion at two discrete contact locations longitudinally offset from each other.

2. The shielded connector according to claim 1, wherein the short-circuit piece is provided with a flange portion corresponding to an inner diameter of the bore of said cylindrical body portion of the connector housing, and said connector housing includes an abutment portion abutting against the flange portion of the short-circuit piece so as to constitute one of said two contact locations.

3. The shielded connector according to claim 2, wherein the short-circuit piece is provided with a clamping body to be connected to the braided covering of the shielded wire and a fixing body which is a portion to be fixed to the connector housing, and a spring piece for contacting the inside surface of the bore is arranged on an outer circumference of the fixing body so as to constitute a second one of said two contact locations.

4. The shielded connector according to claim 1, wherein the short-circuit piece is provided with a clamping body to be connected to the braided covering of the shielded wire and a fixing body which is a portion to be fixed to the connector housing, and a spring piece for pushing to the fixing body is arranged inside the connector housing.

* * * * *